US009074520B2

(12) United States Patent
Bandyopadhyay et al.

(10) Patent No.: US 9,074,520 B2
(45) Date of Patent: Jul. 7, 2015

(54) CYLINDER LINER HAVING INTAKE PORTS FOR IMPROVED SCAVENGING

(75) Inventors: Deep Bandyopadhyay, Naperville, IL (US); Jonathan Dolak, Clarendon Hills, IL (US); Raghavendra Subramanya, Burr Ridge, IL (US)

(73) Assignee: Electro-Motive Diesel, Inc., LaGrange, IL (US)

( * ) Notice: Subject to any disclaimer, the term of this patent is extended or adjusted under 35 U.S.C. 154(b) by 161 days.

(21) Appl. No.: 13/612,980

(22) Filed: Sep. 13, 2012

(65) Prior Publication Data

US 2014/0069358 A1 Mar. 13, 2014

(51) Int. Cl.

| | |
|---|---|
| ***F02B 25/00*** | (2006.01) |
| ***F02B 75/02*** | (2006.01) |
| ***F01L 5/06*** | (2006.01) |
| ***F02B 25/04*** | (2006.01) |
| ***F02F 1/22*** | (2006.01) |
| *F02B 1/00* | (2006.01) |

(52) U.S. Cl.

CPC . *F02B 25/04* (2013.01); *F01L 5/06* (2013.01); *F02B 25/00* (2013.01); *F02B 1/00* (2013.01); *F02B 2075/027* (2013.01); *F02F 1/22* (2013.01)

(58) Field of Classification Search

CPC ..... F02B 1/00; F02B 2075/027; F02B 2075/025; F02B 75/022; F02B 25/00; F02B 2720/131; F01L 5/06

USPC ..... 123/76, 61 V, 69 V, 71 VA, 540

See application file for complete search history.

(56) References Cited

U.S. PATENT DOCUMENTS

| | | | | |
|---|---|---|---|---|
| 1,781,194 | A * | 11/1930 | Riehm | 123/65 A |
| 2,560,700 | A * | 7/1951 | Pervier | 123/41.78 |
| 2,962,009 | A * | 11/1960 | Buchi | 123/65 VC |
| 4,178,886 | A | 12/1979 | Uchinishi | |
| 4,353,333 | A | 10/1982 | Iio | |
| 5,131,354 | A * | 7/1992 | Richeson | 123/76 |
| 6,513,464 | B1 * | 2/2003 | Busch | 123/65 VA |
| 7,025,021 | B1 | 4/2006 | Andersson et al. | |
| 7,363,888 | B2 | 4/2008 | Klimmek et al. | |

FOREIGN PATENT DOCUMENTS

| | | |
|---|---|---|
| JP | 56000518 | 1/1981 |

* cited by examiner

*Primary Examiner* — Lindsay Low
*Assistant Examiner* — Syed O Hasan
(74) *Attorney, Agent, or Firm* — Finnegan, Henderson, Farabow, Garrett & Dunner, LLP

(57) ABSTRACT

A cylinder liner for an engine is disclosed. The cylinder liner may have a hollow cylindrical sleeve extending from a first end to a second end along a longitudinal axis. The cylinder liner may also have a plurality of circumferentially spaced intake ports formed within the sleeve. The plurality of intake ports may have a first intake port positioned at a first axial distance from the first end. The plurality of intake ports may also have a second intake port positioned at a second axial distance from the first end.

23 Claims, 7 Drawing Sheets

CYLINDER LINER HAVING INTAKE PORTS FOR IMPROVED SCAVENGING

TECHNICAL FIELD

The present disclosure relates generally to a cylinder liner, and, more particularly, to a cylinder liner having intake ports for improved scavenging.

BACKGROUND

Internal combustion engines generate exhaust as a by-product of fuel combustion within the engines. Engine exhaust contains, among other things, un-burnt fuel, particulate matter such as soot, and harmful gases such as carbon monoxide or nitrous oxide. To comply with regulatory emissions control requirements, it is desirable to reduce the amount of soot and harmful gases generated by the engine.

One technique for reducing the production of harmful emissions in an engine consists of expelling a majority of the residual gases from the combustion chamber during scavenging. Expelling the majority of residual gases from the combustion chamber allows a cooler intake charge of air with a higher oxygen concentration to be used for the next combustion cycle. This results in improved combustion, which produces smaller amounts of soot and lower concentrations of carbon monoxide and nitrous oxide gases.

U.S. Pat. No. 4,353,333 B2 to Iio. ("the '333 patent") describes the use of two auxiliary ports located on either side of a single intake port in a two cycle engine. The auxiliary ports serve to increase the area through which air can enter a combustion chamber during scavenging. The two auxiliary ports of the '333 patent have a smaller width along the circumference compared to the primary intake port, and have heights about equal to that of the primary intake port.

Although the '333 patent discloses the use of additional ports to improve scavenging, merely adding two ports may not be sufficient to meet the emissions standards applicable to modern engines. Moreover, the number of intake ports which can be added to an engine cylinder may be limited by the circumferential surface area available on the cylinder. In addition, merely adding auxiliary ports as disclosed by the '333 patent may not help to achieve a uniform temperature in the combustion chamber after scavenging.

The cylinder liner of the present disclosure solves one or more of the problems set forth above and/or other problems in the art.

SUMMARY

In one aspect, the present disclosure is directed to a cylinder liner for an engine. The cylinder liner may include a hollow cylindrical sleeve extending from a first end to a second end along a longitudinal axis. The cylinder liner may also include a plurality of circumferentially spaced intake ports formed within the sleeve. The plurality of intake ports may include a first intake port positioned at a first axial distance from the first end. The plurality of intake ports may also include a second intake port positioned at a second axial distance from the first end.

In another aspect, the present disclosure is directed to a method of scavenging an engine. The method may include opening exhaust valves disposed in a cylinder head of a cylinder pack to allow exhaust gases to exit the cylinder pack. The method may also include opening a first intake port formed within a cylinder liner of the engine at a first crank angle during an intake stroke of a piston reciprocatingly disposed within the cylinder liner. In addition, the method may include opening a second intake port formed within the cylinder liner at a second crank angle during the intake stroke of the piston.

DETAILED DESCRIPTION

Figure 1:
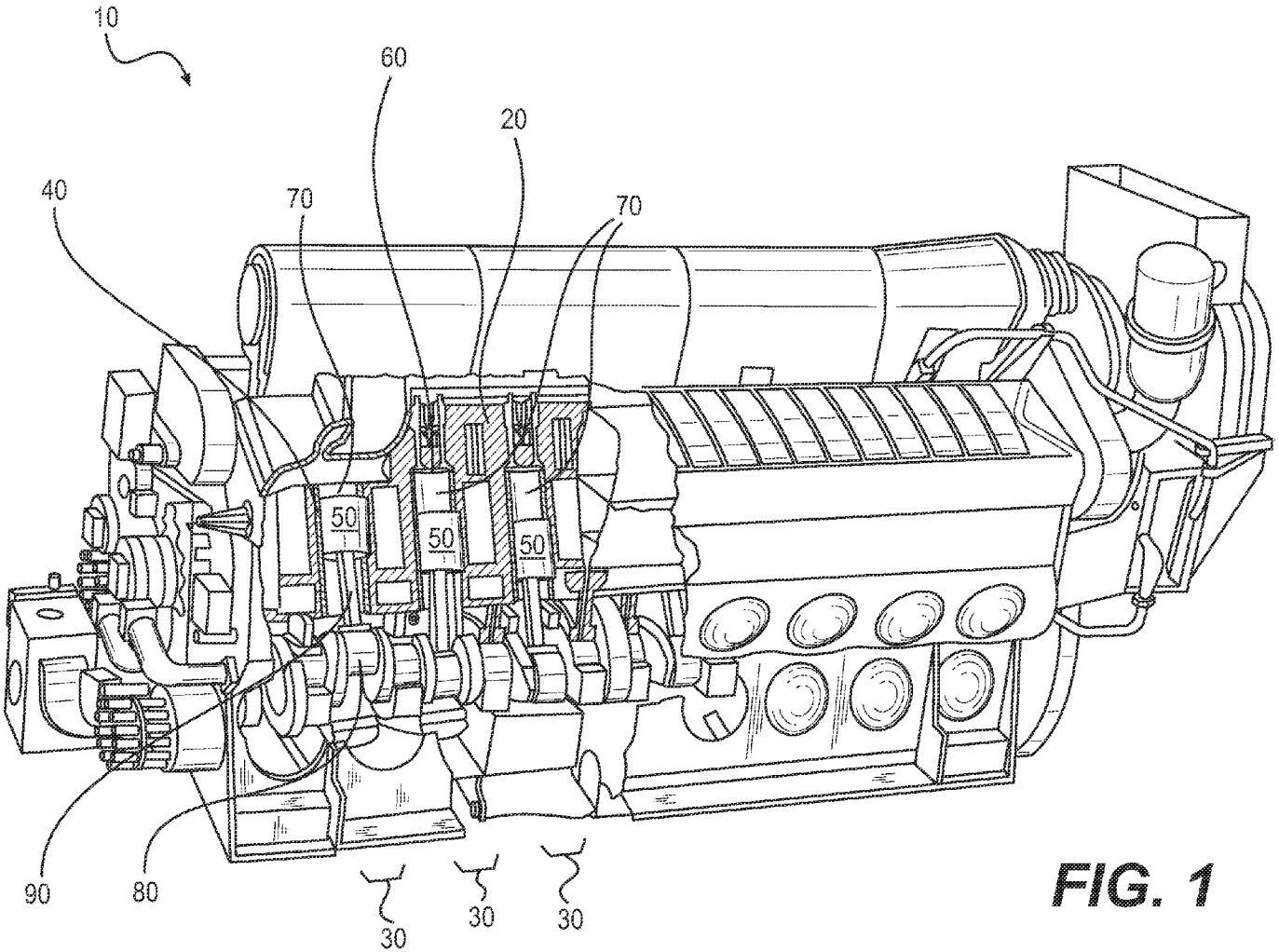
FIG. 1 is a schematic and diagrammatic illustration of an exemplary disclosed engine.

FIG. 1 illustrates an exemplary internal combustion engine 10. Engine 10 may be a two-stroke diesel engine. One skilled in the art will recognize, however, that engine 10 may be any other type of internal combustion engine such as, for example, a four-stroke diesel engine, a gasoline engine, or a gaseous-fuel-powered engine. Engine 10 may include an engine block 20 that at least partially defines a plurality of cylinder packs 30. Each cylinder pack 30 may have a cylinder liner 40, a piston 50 slidably disposed within cylinder liner 40, a cylinder head 60 attached to cylinder liner 40, and a connecting rod 90. Cylinder liner 40, piston 50, and cylinder head 60 may form a combustion chamber 70. In the embodiment illustrated in FIG. 1, engine 10 includes sixteen combustion chambers 70. It is contemplated, however, that engine 10 may include a greater or lesser number of combustion chambers 70. Moreover, combustion chambers 70 in engine 10 may be disposed in an "in-line" configuration, a "V" configuration (as shown in FIG. 1), or in any other suitable configuration.

As also shown in FIG. 1, engine 10 may include a crankshaft 80 rotatably disposed within engine block 20. Connecting rod 90 may connect each piston 50 to crankshaft 80. The reciprocal movement of piston 50 within combustion chamber 70 may be transferred to a rotational movement of crankshaft 80 by connecting rod 90. Similarly, the rotation of crankshaft 80 may be transferred as a reciprocating movement of piston 50 within combustion chamber 70 by connecting rod 90.

Figure 2:
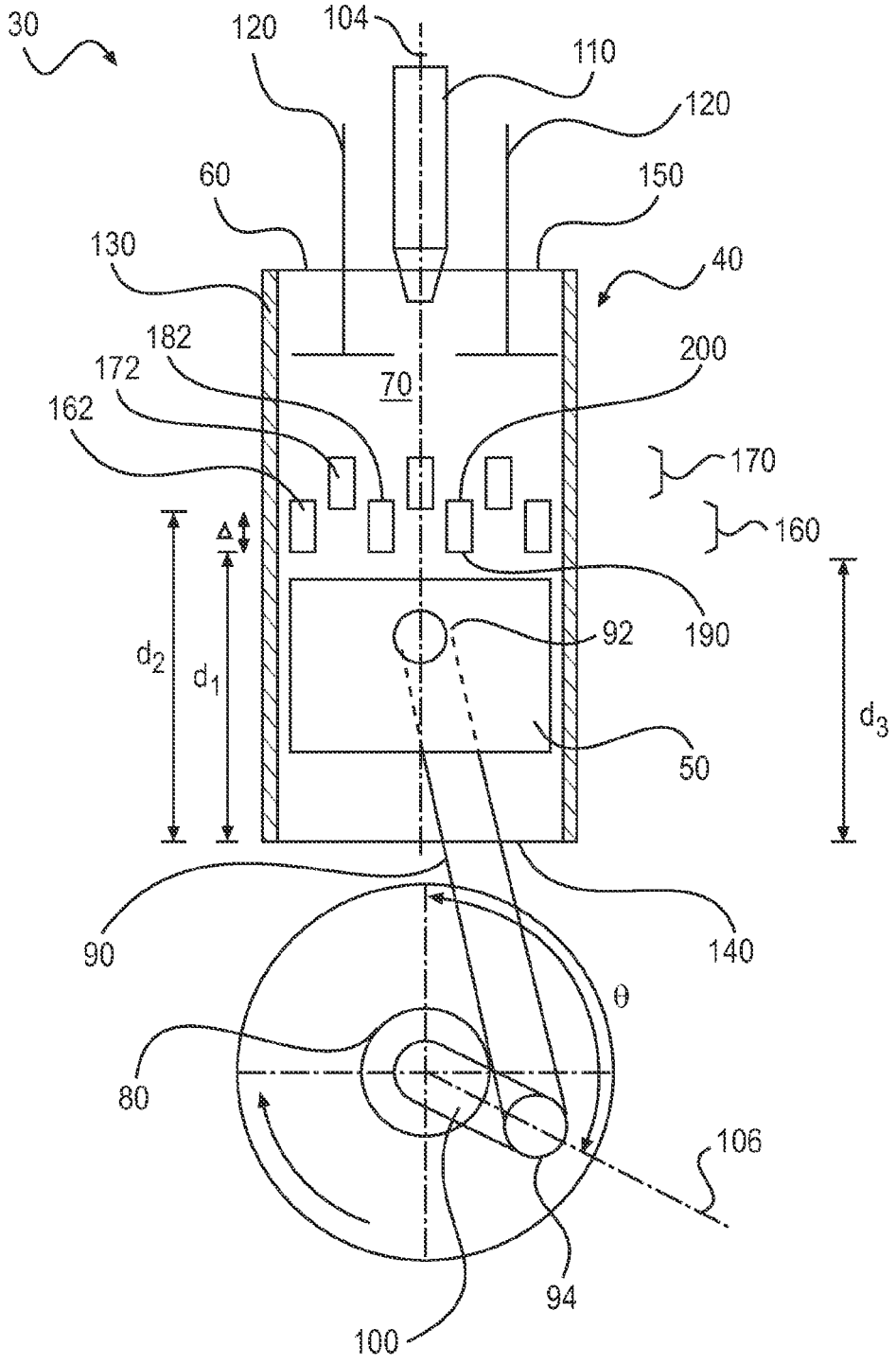
FIG. 2 is a pictorial illustration of an exemplary disclosed cylinder pack for the engine of FIG. 1.

FIG. 2 illustrates an exemplary cylinder pack 30 for engine 10. Cylinder pack 30 may include a cylinder head 60, a cylinder liner 40, a piston 50, and a connecting rod 90. Cylinder head 60 may include one or more fuel injectors 110 for injecting fuel into combustion chamber 70. Cylinder head 60 may also include one or more exhaust valves 120 to allow exhaust gases to exit from combustion chamber 70 during a scavenging operation after combustion. As also illustrated in FIG. 2, connecting rod 90 may have a first rod end 92 connected to piston 50 and a second rod end 94 connected to crankshaft 80 via crankshaft arm 100.

Piston 50 may be configured to reciprocate within cylinder liner 40 between a top-dead-center (TDC) and a bottom-dead-center (BDC). An axial position of piston 50 in cylinder liner 40 may also be represented by a crank angle θ. Crank angle θ as used in this disclosure is the angle between a longitudinal axis 104 of cylinder liner 40 and a longitudinal axis 106 of crankshaft arm 100 measured in a clockwise direction from longitudinal axis 104. As crankshaft 80 rotates through about 180° degrees, piston 50 may move through one full stroke between the TDC position and the BDC position. Thus, at the TDC position the crank angle θ will be 0° and at the BDC position crank angle θ will be 180°.

Cylinder liner 40 may include a hollow cylindrical sleeve 130, which has a first end 140 located nearer crankshaft 80 and a second end 150, which may be connected to cylinder head 60. Sleeve 130 may include a plurality of intake ports 160, 170 formed within sleeve 130. Intake ports 160, 170 may be configured to permit fresh air to enter combustion chamber 70 and may be circumferentially spaced on sleeve 130. Intake ports 160, 170 may be generally rectangular in shape. A rectangular shape for intake ports 160, 170 may be chosen for ease of manufacturing, for example, using a casting process. It is contemplated, however, that intake ports 160, 170 may be circular in shape or may have any other appropriate shape know in the art. As piston 50 moves from the TDC position to the BDC position, piston 50 will reach a position at which one or more of intake ports 160, 170 will be unblocked (opened) by piston 50 allowing fresh air to enter combustion chamber 70 through intake ports 160, 170. Unblocked or opened, as used in this disclosure, refers to the condition where piston 50 either partially or fully uncovers intake ports 160, 170 allowing fresh air to enter combustion chamber 70.

As illustrated in FIG. 2, sleeve 130 may include a first intake port 162 positioned at a first axial distance $d_1$ from first end 140 and a second intake port 172 positioned at a second axial distance $d_2$ from first end 140. Further, sleeve 130 may include a third intake port 182 positioned at a third axial distance $d_3$ from first end 140. Although axial distances $d_1$, $d_2$, and $d_3$ are shown as axial distances from first end 140 to lower edges 190 of intake ports 162, 172, and 182, it is contemplated that axial distances $d_1$, $d_2$, and $d_3$ may be measured from first end 140 to upper edges 200 of intake ports 162, 172, and 182. The first, second, and third axial distances $d_1$, $d_2$, and $d_3$ may be the same or different. It is also contemplated that the axial locations of intake ports 162 and 172 relative to first end 140 may be defined in terms of an offset Δ as shown in FIG. 2. As used in this disclosure, offset Δ may be determined as a distance between the lower edges 190 or upper edges 200 of any two intake ports. In one exemplary embodiment, Δ may range from about 10 mm to 40 mm.

As illustrated in FIG. 2, second axial distance $d_2$ may be larger than first axial distance $d_1$. By offsetting the second intake port 172 from the first intake port 162, the time period during which fresh air may enter combustion chamber 70 may be increased. For example, as piston 50 moves from the TDC position to the BDC position, during an intake stroke, piston 50 may partially or fully unblock (open) second intake port 172 before first intake port 162. In terms of crank angle, piston 50 may unblock first intake port 162 at a first crank angle and second intake port 172 at a second crank angle. Moreover, as illustrated in the exemplary embodiment of FIG. 2, second crank angle may be smaller than first crank angle. As piston 50 moves from the BDC position to the TDC position, during a compression stroke, piston 50 may block first intake port 162 before blocking second intake port 172. In terms of crank angle, piston 50 may block first intake port 162 at a third crank angle and second intake port 172 at a fourth crank angle. Moreover, as illustrated in the exemplary embodiment of FIG. 2, third crank angle may be smaller than fourth crank angle. By opening second intake port 172 before opening first intake port 162 and subsequently by closing second intake port 172 after closing first intake port 162, fresh air may enter combustion chamber 70 over a longer time period. Increasing the time period over which fresh air may enter combustion chamber 70 may help ensure more fresh air enters combustion chamber 70 and drives out more of the residual gases from combustion chamber 70 through exhaust valves 120 during the scavenging operation. As a result, the intake air charge in combustion chamber 70 may have a higher concentration of oxygen and a lower temperature, which may help improve combustion efficiency. Improved combustion efficiency may in turn lead to lower production of soot and reduced concentrations of carbon monoxide, nitrous oxide, and other harmful gases.

As further illustrated in FIG. 2, first axial distance $d_1$ may be about equal to third axial distance $d_3$ and second axial distance $d_2$ may be larger than first and third axial distances $d_1$ and $d_3$. In this manner, every other (alternate) intake port may be positioned at a larger axial distance from first end 140 as compared to the immediately adjacent intake port. In another exemplary embodiment, first intake port 162 may belong to a first set of intake ports 160 and second intake port 172 may belong to a second set of intake ports 170. Each intake port in the first set of intake ports 160 may be positioned at the same first axial distance $d_1$ and each intake port in the second set of intake ports 170 may be positioned at the same second axial distance $d_2$, which may be the same or different from first axial distance $d_1$. The number of intake ports in the first and second sets of intake ports 160, 170 may be desirably selected to ensure that engine 10 produces the desired amount of power while meeting the emissions requirements. Similarly axial distances $d_1$, $d_2$, and $d_3$ may be desirably selected to ensure that engine 10 produces the desired amount of power while meeting the emissions requirements.

Figure 3:
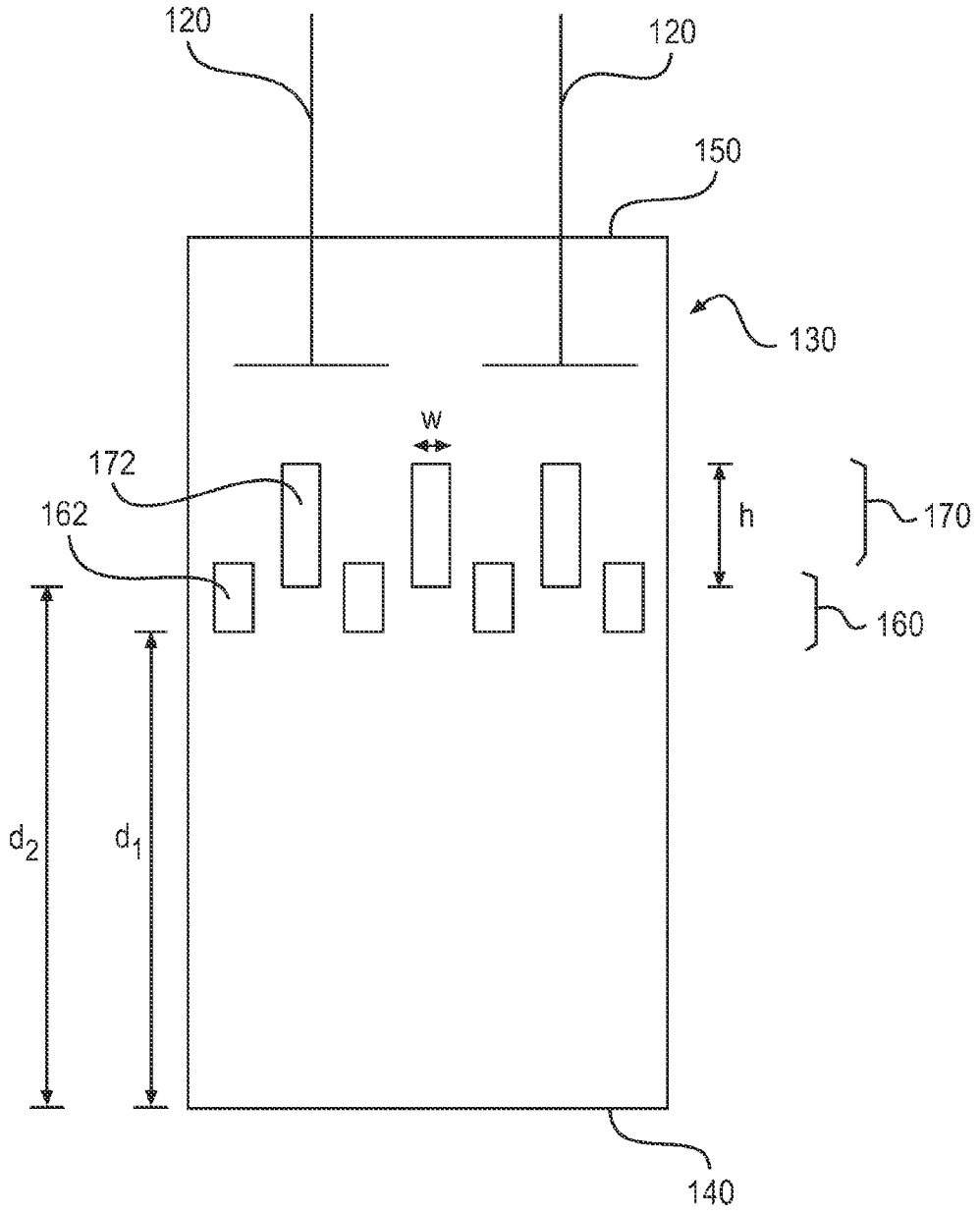
FIGS. 3-6 are pictorial illustrations of additional exemplary embodiments of a cylinder liner used in the cylinder pack of FIG. 2.

FIG. 3 illustrates another exemplary embodiment of sleeve 130 for cylinder pack 30. As shown in FIG. 3, sleeve 130 may have a first intake port 162 that may have a size smaller than a second intake port 172. The size of second intake port 172 may be made larger than the size of first intake port 162 by increasing a height "h," by increasing a width "w," or by increasing both the height and the width. One skilled in the art would recognize, however, that the amount by which the width of an intake port may be increased may be limited by the amount of circumferential area available on sleeve 130. FIG. 3 also illustrates that the second axial distance $d_2$ of second intake port 172 may be larger than first axial distance $d_1$ of first intake port 162. It is contemplated, however, that the second axial distance $d_2$ of second intake port 172 may be smaller than first axial distance $d_1$ of first intake port 162. The size and axial locations of intake ports 160, 170 may be desirably selected to ensure that a sufficient amount of air enters combustion chamber 70 through intake ports 160, 170 during scavenging operations to help improve combustion efficiency and reduce emissions.

Figure 4:
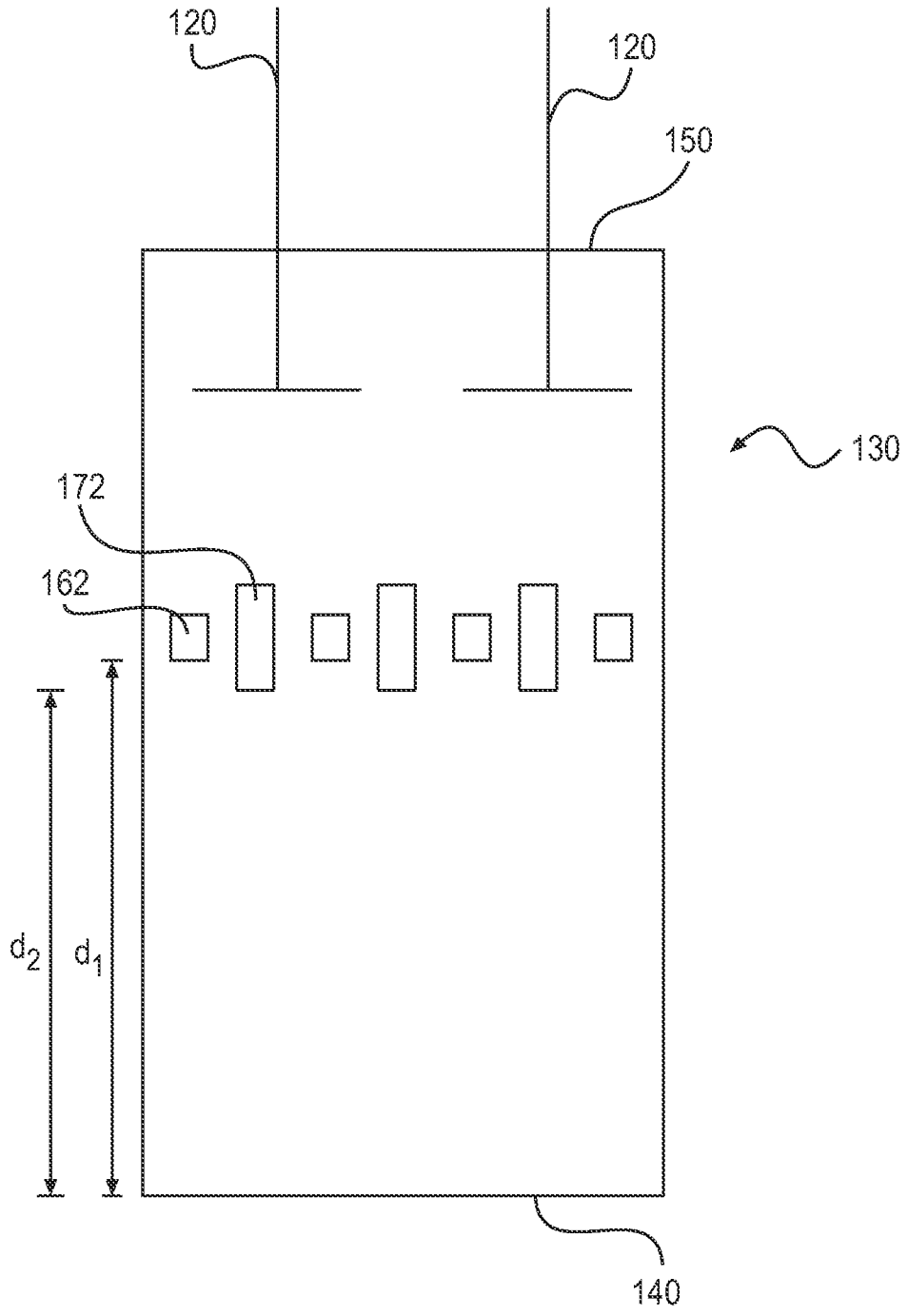

FIG. 4 illustrates another exemplary embodiment of sleeve 130 for cylinder pack 30. As shown in FIG. 4, first intake port 162 may be positioned at an axial distance $d_1$, second intake port 172 may be positioned at an axial distance $d_2$, and axial distance $d_1$ may be larger than axial distance $d_2$. As also illustrated in FIG. 4, second intake port 172 may be larger than first intake port 162. As discussed above, the size and axial position of intake ports 162, 172 may be selected to ensure that a sufficient amount of air enters combustion chamber 70 through intake ports 160, 170 during scavenging operations to help improve combustion efficiency and reduce emissions.

Figure 5:
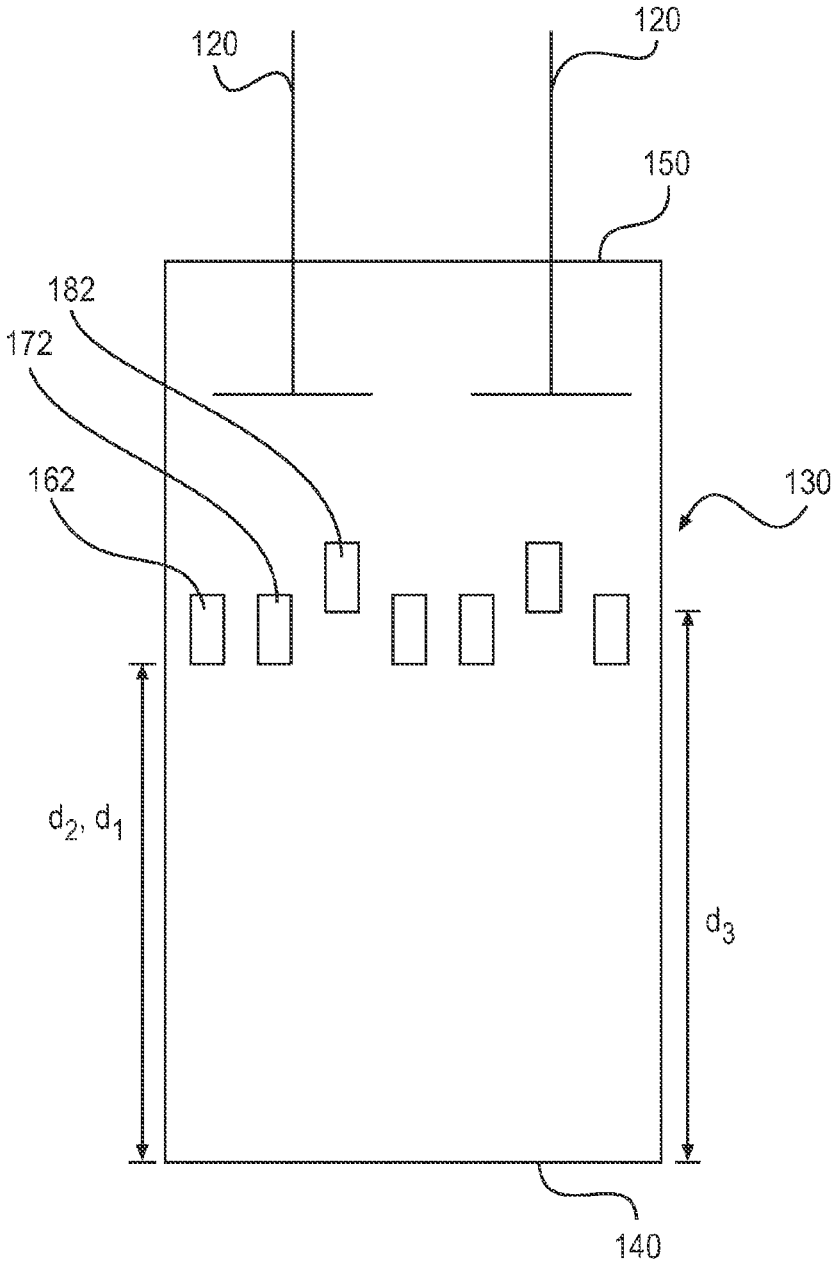

FIG. 5 illustrates another exemplary embodiment of sleeve 130 for cylinder pack 30. As shown in FIG. 5, sleeve 130 may have first and second intake ports 162 and 172, which may be positioned such that first and second axial distances $d_1$ and $d_2$ are equal. Third intake port 182 may be positioned at a third axial distance $d_3$ which may be larger than first and second axial distances $d_1$ and $d_2$. Thus, every third intake port 182 may be positioned at a greater axial distance from first end 140 compared to the immediately preceding two intake ports 162, 172. It is also contemplated that other arrangements, different from those illustrated in FIGS. 2 and 5 may be used, for example, wherein every fourth, or fifth, or nth intake port is positioned at an axial distance greater than that of the other immediately adjacent intake ports.

Figure 6:
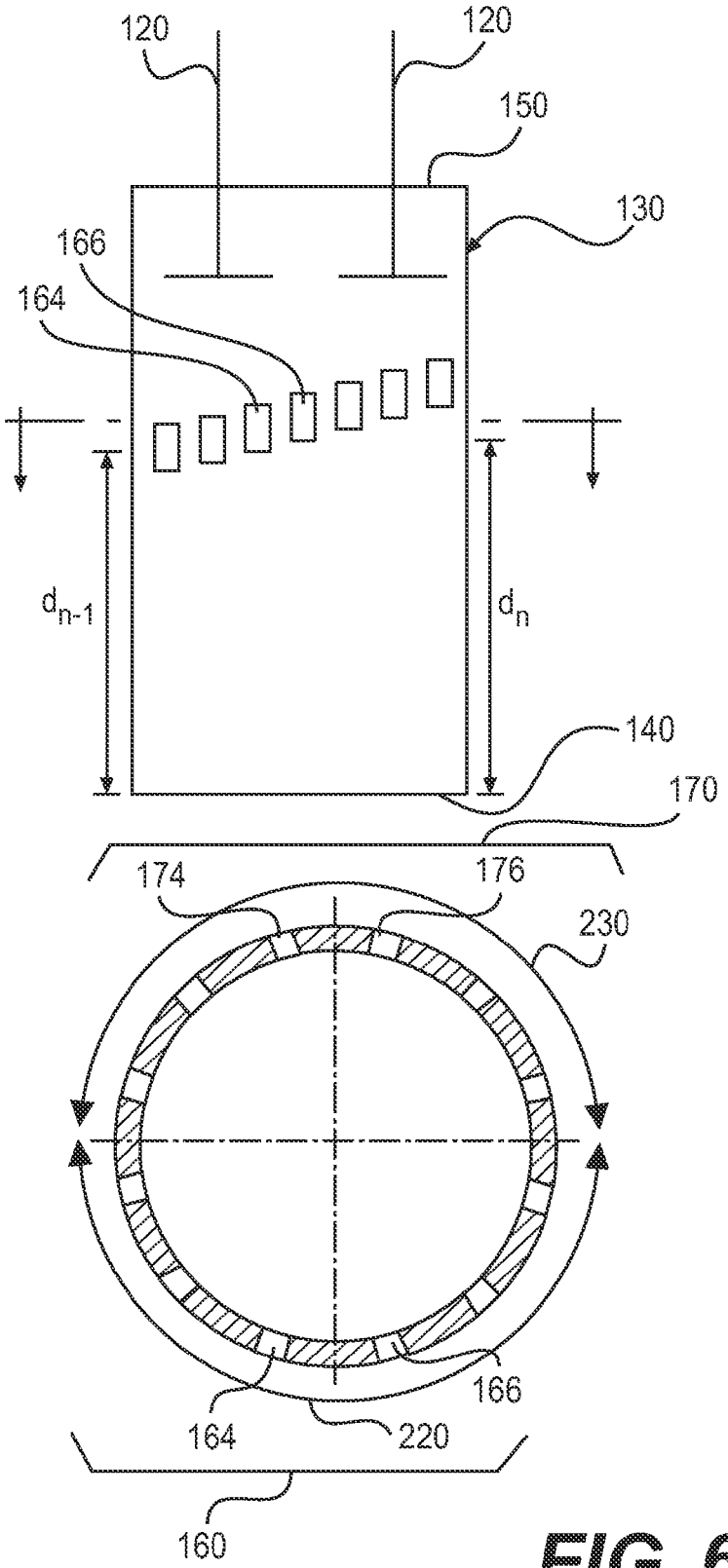

FIG. 6 illustrates another exemplary embodiment of sleeve 130 for cylinder pack 30. As shown in FIG. 6, sleeve 130 may have a first set of intake ports 160 arranged circumferentially over a circumferential half 220 of sleeve 130 and a second set of intake ports 170 arranged circumferentially over a remaining circumferential half 230 of sleeve 130. As further illustrated in FIG. 6, an nth intake port 166 in the first set of intake ports 160 may be positioned at an axial distance $d_n$ from first end 140. Similarly an (n−1)th intake port 164 in the first set of intake ports may be positioned at an axial distance $d_{n-1}$ from first end 140. Axial distance $d_{n-1}$ may be smaller than axial distance $d_n$. Thus, each successive intake port 166 in the first set of intake ports 160 may be positioned further from first end 140 of sleeve 130. Intake ports, for example 174, 176, in the second set of intake ports 170 may be arranged in a similar manner.

In one exemplary embodiment, an intake port 164 in the first set of intake ports 160 may be disposed opposite an intake port 174 in the second set of intake ports 170 and both intake ports 164 and 174 may be positioned at about the same axial distance from first end 140. Thus, intake ports on one side of combustion chamber 70 may be positioned further from first end 140 as compared to intake ports positioned elsewhere on combustion chamber 70. The exemplary embodiment of FIG. 6 may help ensure that cooler intake air enters portions of combustion chamber 70 for a longer duration (for example through intake port 176) and for a smaller duration in other portions (for example through intake port 174). Such a non-uniform intake air distribution may help cool hotter portions of combustion chamber 70. For example, in V-shaped engines, portions of combustion chamber 70 adjacent to each other and nearer the axis of symmetry of the V-shaped arrangement may be hotter than portions located further away from the axis of symmetry. Allowing fresh air to enter the hotter portions of combustion chamber 70 over a longer duration may help ensure that those portions of combustion chamber 70 cool down thereby ensuring a near uniform temperature in combustion chamber 70. Such uniformity of temperature may help improve combustion efficiency thereby helping to reduce formation of soot and other harmful gases during combustion.

INDUSTRIAL APPLICABILITY

The cylinder liner of the present disclosure has wide applications in a variety of engine types including, for example, diesel engines, gasoline engines, and gaseous fuel-powered engines. The disclosed cylinder liner may be implemented into any engine wherein it may be advantageous to allow more time for air to enter the combustion chamber during the intake stroke. The operation of a cylinder pack 30 with the disclosed sleeve 130 will be discussed next.

In an exemplary two-stroke engine 10, a complete rotation of crankshaft 80 may include an intake stroke (TDC to BDC) and a compression stroke (BDC to TDC). During a final phase of the intake stroke described above, exhaust valves 120 may be opened to allow exhaust gases to exist combustion chamber 70. In addition, air may be drawn into combustion chamber 70 via intake ports 160, 170. In particular, as piston 50 moves from the TDC position to the BDC position within cylinder liner 40, piston 50 may eventually reach a position at which one or more of intake ports 160, 170 may no longer be blocked by piston 50 and instead may be fluidly communicated with combustion chamber 70. When intake ports 160, 170 are in fluid communication with combustion chamber 70 and a pressure of air at intake ports 160, 170 is greater than a pressure within combustion chamber 70, air may pass from an intake manifold (not shown) through intake ports 160, 170 into combustion chamber 70. As fresh air enters combustion chamber 70, it may drive out exhaust gases through exhaust valves 120 as part of a scavenging operation.

As piston 50 moves from the BDC to the TDC position, during a compression stroke, intake ports 160, 170 may be blocked by piston 50 cutting of intake of fresh air. Fuel may be mixed with the air before, during, or after the air is drawn into combustion chamber 70. Exhaust valves 120 may be closed and further upward motion of piston 50 during the compression stroke may compress the fuel/air mixture trapped in combustion chamber 70. As the fuel/air mixture within combustion chamber 70 is compressed, the temperature of the mixture will increase. Eventually, the pressure and temperature of the mixture will reach a point at which the mixture may combust pushing piston 50 away from the TDC position towards the BDC position causing crankshaft 80 to rotate. At a particular point during the travel of piston 50 from the TDC position to the BDC position, one or more exhaust valves 120 disposed within cylinder head 60 may open to allow pressurized exhaust within combustion chamber 70 to exit. Further, air may enter combustion chamber 70 through intake ports 160, 170 and the entire process may then be repeated during continuous operation of engine 10.

The time at which intake ports 160, 170 are opened (i.e., unblocked by piston 50 and fluidly communicated with combustion chamber 70) and the duration for which intake ports 160, 170 are allowed to remain open may have an effect on an amount of air that passes into combustion chamber 70. The opening and/or closing times and open duration of intake ports 160, 170 may also have an effect on a temperature of the air directed into combustion chamber 70. For example, opening intake ports 160, 170 earlier and increasing the duration for which they remain open may allow cool intake air to drive out more of the exhaust gases from combustion chamber 70 and simultaneously cool combustion chamber 70. The time period during which air may enter combustion chamber 70 may be increased by positioning second intake port 172 at an axial distance $d_2$ from first end 140, which is larger than axial distance $d_1$ from first end 140 of first intake port 162 as shown in FIG. 2. As piston 50 moves from the TDC position to the BDC position, it will unblock second intake port 172 at a second crank angle before unblocking first intake port 162 at a first crank angle larger than the second crank angle. Similarly as piston 50 moves from the BDC position to the TDC position, piston 50 will block intake port 162 at a third crank angle before blocking second intake port 172 at a larger fourth crank angle.

Although FIG. 2 illustrates an embodiment in which the first crank angle is smaller than the second crank angle and the third crank angle is smaller than the fourth crank angle, it is contemplated that other arrangements of first and second intake ports 162, 172 may be possible. For example, as illustrated in FIG. 4, as piston 50 moves from the BDC position to the TDC position, piston 50 will block second intake port 172 before blocking first intake port 162. In this case, therefore, piston 50 will block second intake port 172 at a fourth crank angle, which may be smaller than a third crank angle at which piston 50 can block first intake port 162.

Figure 7:
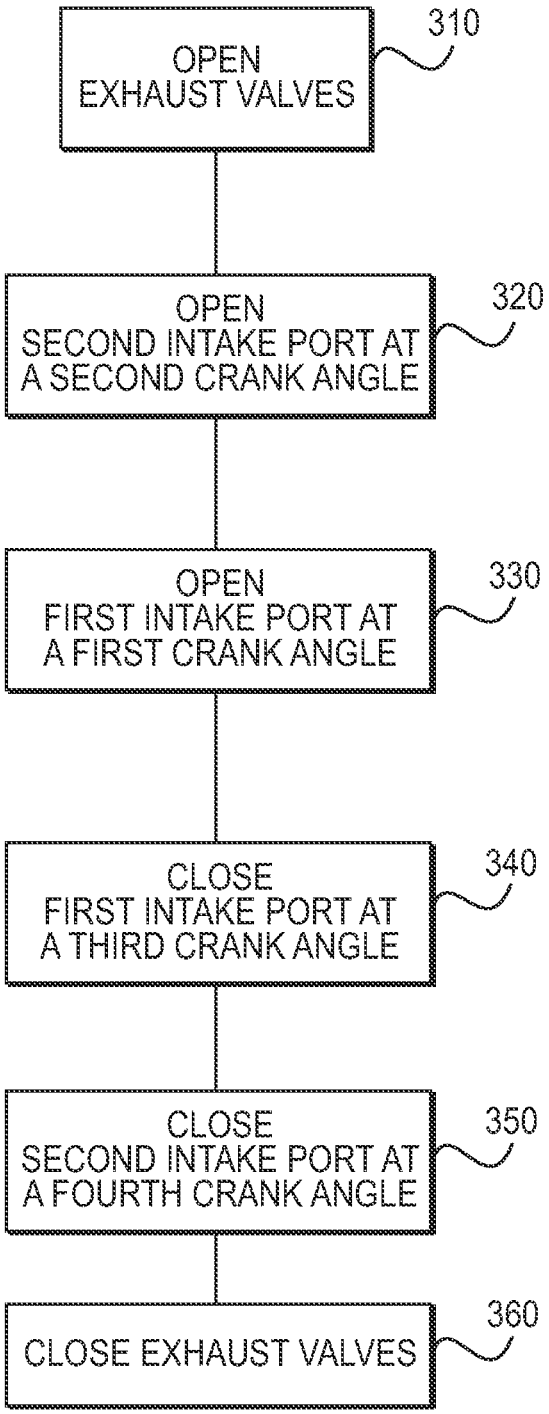
FIG. 7 is a flow chart illustrating an exemplary disclosed method performed by the cylinder pack of FIG. 2.

In another exemplary embodiment as shown in FIG. 7, as piston 50 moves from the TDC position to the BDC position, nth intake port 166 will be unblocked before the (n−1)th intake port 164. Thus, in this case, the nth intake port 166 will be unblocked at a smaller crank angle compared to the (n−1) th intake port 164. On the other hand, as piston 50 moves from the BDC position to the TDC position, piston 50 will block the (n−1)th intake port 164 before it can block nth intake port 166. In this case, therefore, piston 50 will block the (n−1)th intake port 164 at a smaller crank angle compared to the crank angle at which it blocks the nth intake port 166. Thus, for the embodiment illustrated in FIG. 7, each successive intake port will be unblocked at a larger and larger crank angle. Moreover, intake ports unblocked at relatively smaller crank angles will be blocked by piston 50 at relatively larger crank angles.

Increasing the time for which intake ports 160, 170 remain open or increasing the size of intake ports 160, 170 may allow a cooler intake charge with a higher oxygen concentration in combustion chamber 70. The increased oxygen concentration my help improve combustion efficiency which in turn may result in reduced soot production and lower concentrations of carbon dioxide, water, and other harmful gases after combustion. A method of scavenging a combustion chamber 70 using the disclosed cylinder liner 40 will now be described.

During operation of combustion chamber 70 having a cylinder liner as illustrated in FIG. 2, piston 50 may move from the TDC position to the BDC position during an intake stroke. As piston 50 moves from the TDC position towards the BDC position, exhaust valves 120 may open to allow residual exhaust gases to leave combustion chamber 70 (Step 310). As piston 50 continues to move towards the BDC position, it may open second intake port 172 at a second crank angle (Step 320). Piston 50 may continue to move towards the BDC position and may open first intake port 162 at a first crank angle larger than the second crank angle (Step 330). Piston 50 may reach the BDC position and may begin moving towards the TDC position, during a compression stroke. As piston 50 moves from the BDC position towards the TDC position, it may block first intake port 162 at a third crank angle (Step 340). As piston 50 continues to move towards the TDC position, piston 50 may block second intake port 172 at a fourth crank angle, which may be larger than the third crank angle (Step 350). Exhaust valves 120 may be closed to prevent loss of fresh intake air from combustion chamber 70 (Step 360). It is contemplated the steps 310 through 360 may be executed in any order depending on the axial location, size, and arrangement of intake ports 160, 170. Moreover, although the method of scavenging has been described in terms of only the first and second intake ports 162, 172, one skilled in the art would recognize that the method may be applied to more than one intake port or to more than one sets of intake ports (for example, 160, 170) and that the timing and order in which one or more of the intake ports are blocked or unblocked may be appropriately adjusted to achieve the desired engine performance and level of emissions.

It will be apparent to those skilled in the art that various modifications and variations can be made to the disclosed cylinder liner without departing from the scope of the disclosure. Other embodiments of the cylinder liner will be apparent to those skilled in the art from consideration of the specification and practice of the cylinder liner disclosed herein. It is intended that the specification and examples be considered as exemplary only, with a true scope of the disclosure being indicated by the following claims and their equivalents.

What is claimed is:

1. A cylinder liner for an engine, comprising:

a hollow cylindrical sleeve extending from a first end to a second end along a longitudinal axis;

a plurality of circumferentially spaced intake ports formed within the sleeve, including:

a first intake port positioned at a first axial distance from the first end;

a second intake port positioned at a second axial distance from the first end, the second axial distance being different from the first axial distance and an offset between the first and second intake ports being less than a height of the first intake port; and a third intake port positioned at a third axial distance from the first end wherein:

the second intake port is disposed between the first and third intake ports; and the third axial distance is larger than the first and second axial distances.

2. The cylinder liner of claim 1, wherein the second intake port is disposed adjacent the first intake port and the second axial distance is greater than the first axial distance.

3. The cylinder liner of claim 1, wherein each of the plurality of intake ports has a generally rectangular shape.

4. The cylinder liner of claim 3, further including a third intake port positioned at a third axial distance from the first end, wherein the second intake port has a larger area than the first and third intake ports.

5. The cylinder liner of claim 4, wherein:

the first, second, and third intake ports have about the same width; and a height of the second intake port is greater than heights of the first and third intake ports.

6. The cylinder liner of claim 1, wherein the plurality of intake ports includes:

a first set of intake ports disposed over a circumferential half of the sleeve, the first set of intake ports including the first intake port; and a second set of intake ports disposed opposite the first set of intake ports over a remaining circumferential half of the sleeve, the second set of intake ports including the second intake port, wherein each successive intake port in the first set of intake ports is positioned further from the first end.

7. The cylinder liner of claim 6, wherein each successive intake port in the second set of intake ports is positioned further from the first end.

8. The cylinder liner of claim 7, wherein the first intake port is disposed opposite the second intake port and the first and second intake ports are positioned at about a same axial distance from the first end.

9. A method of scavenging an engine, comprising:

opening an exhaust valve disposed in a cylinder head of a cylinder pack to allow exhaust gases to exit the cylinder pack;

opening a first intake port, formed within a cylinder liner of the cylinder pack, at a first crank angle during an intake stroke of a piston reciprocatingly disposed within the cylinder liner;

opening a second intake port, formed within the cylinder liner, at a second crank angle when the first intake port is open during the intake stroke of the piston; and opening a third intake port, formed within the cylinder liner at a third crank angle different from the first crank angle and the second crank angle.

10. The method of claim 9, further including:

closing the first intake port during a compression stroke of the piston at a fourth crank angle; and closing the second intake port during the compression stroke of the piston at a fifth crank angle.

11. The method of claim 10, further including:

closing the exhaust valve during the compression stroke of the piston after closing the first and second intake ports.

12. The method of claim 11, wherein the second crank angle is smaller than the first crank angle.

13. The method of claim 12, wherein the fourth crank angle is smaller than the fifth crank angle.

14. The method of claim 10, wherein the fourth crank angle is larger than the fifth crank angle.

15. The method of claim 11, wherein:

opening the first intake port includes opening a first set of intake ports circumferentially disposed on the cylinder liner; and opening the second intake port includes opening a second set of intake ports circumferentially disposed on the cylinder liner.

16. The method of claim 15, further including opening each successive port in the first set of intake ports at successively larger crank angles.

17. The method of claim 16, further including opening each successive port in the second set of intake ports at successively larger crank angles.

18. A cylinder pack for an engine, comprising:

a cylinder head;

a cylinder liner connected to the cylinder head, the cylinder liner including:

a hollow cylindrical sleeve extending from a first end to a second end along a longitudinal axis;

a first set of circumferentially spaced intake ports formed within the sleeve at a first axial distance from the first end; and a second set of circumferentially spaced intake ports formed within the sleeve at a second axial distance from the first end, the second axial distance being different from the first axial distance and an offset between the first and second axial distances being less than a height of the first set of intake ports, wherein each intake port in the second set of intake ports is disposed between adjacent intake ports in the first set of intake ports;

a piston reciprocatingly disposed within the cylinder liner; and a connecting rod connected at a first rod end to the piston and connectable at a second rod end to a crankshaft.

19. The cylinder pack of claim 18, further including an exhaust valve disposed in the cylinder head.

20. The cylinder pack of claim 19, wherein each intake port in the first set of intake ports is disposed between adjacent intake ports in the second set of intake ports.

21. The cylinder pack of claim 20, wherein the second axial distance is greater than the first axial distance.

22. The cylinder pack of claim 19, wherein:

the first set of intake ports is disposed over a circumferential half of the sleeve;

the second set of intake ports is disposed opposite the first set of intake ports over a remaining circumferential half of the sleeve; and each successive intake port in each of the first and second sets of intake ports is positioned further from the first end.

23. The cylinder pack of claim 22, wherein:

a first port in the first set of intake ports is disposed opposite a second port in the second set of intake ports; and the first and second ports are positioned at about a same axial distance from the first end.

* * * * *